United States Patent [19]

Duda

[11] 4,266,317

[45] May 12, 1981

[54] VACUUM CLEANING APPARATUS

[76] Inventor: John Duda, 6313 N. Wayne Ave., Chicago, Ill. 60660

[21] Appl. No.: 40,091

[22] Filed: May 18, 1979

[51] Int. Cl.[3] ..... A47L 7/00

[52] U.S. Cl. ..... 15/322; 15/144 A; 15/321; 15/361; 15/401; 15/411

[58] Field of Search ..... 15/321, 322, 353, 1.7, 15/401, 144 A, 361, 410, 411

[56] References Cited

U.S. PATENT DOCUMENTS

| | | | |
|---|---|---|---|
| 1,970,290 | 8/1934 | Ernzer | 15/1.7 |
| 2,038,697 | 4/1936 | Winslow | 15/411 X |
| 2,893,044 | 7/1959 | Kurose | 15/322 |
| 3,019,462 | 2/1962 | Nash et al. | 15/1.7 |
| 3,102,289 | 9/1963 | Norris | 15/411 X |
| 3,599,272 | 8/1971 | Merrick | 15/321 |
| 3,694,263 | 9/1972 | Korn | 15/1.7 X |
| 3,896,521 | 7/1975 | Parise | 15/322 X |
| 3,992,747 | 11/1976 | Hufton | 15/322 X |
| 4,083,077 | 4/1978 | Knight et al. | 15/322 X |
| 4,164,055 | 8/1979 | Townsend | 15/321 |

*Primary Examiner*—Christopher K. Moore
*Attorney, Agent, or Firm*—Edward R. Lowndes

[57] ABSTRACT

A sanitizing hand-manipulated vacuum cleaning apparatus embodying a floor-engaging suction head including a front squeegee and a rear abrasive pad establishing a suction chamber therebetween which is adapted to be connected to a source of sub-atmospheric pressure. The suction head is rigidly connected by a horizontal beam to a rear caster supported carriage, while an elongated handle has its lower end connected by a universal joint to the beam adjacent the rear end of the latter. The suction head, beam and carriage, by reason of their position relative to one another, and by reason of the universal joint connection to the beam, are capable of traversing the floor so that they will follow the guiding movements of the handle in a manner similar to that which obtains when the trailing absorbent strings of a conventional mop follow and are guided by manipulation of the mop handle. A pneumatic connection between the suction head and the source of sub-atmospheric pressure is provided and, if desired, a fluid connection leading from a source of a detergent fluid may be provided for floor wetting purposes exteriorly and rearwardly of the abrasive pad in the immediate vicinity of the latter.

12 Claims, 6 Drawing Figures

VACUUM CLEANING APPARATUS

The improved vacuum cleaning apparatus comprising the present invention has been designed for use primarily in connection with the wet cleaning and drying of floors associated with pharmaceutical laboratories, hospitals, nursing homes and the like, utilizing a suitable detergent solution, thus leaving them in a substantially bacteria-free condition. The invention is however capable of other uses and the same may, with or without modification as desired, be employed for household or other uses. Irrespective however of the particular use to which the invention may be put, the essential features thereof remain substantially the same.

There are at the present time currently in use vacuum mopping devices for removing water from a previously wetted floor surface, such a device usually employing a suction head having spaced apart squeegee elements from between which the water or other cleaning solution is sucked. Some of these devices also have facilities for applying the cleaning liquid to the floor, either within the suction head or in the immediate vicinity thereof. Where the liquid is not supplied and the floor is pre-wetted, the operator is required to traverse the wet floor to remove the liquid for floor drying purposes. This necessitates his walking over portions of the pre-wetted floor. Where a bacteria-free operation is essential, such a method is entirely unsuited for use since the operator would have to remove his wet shoes after his floor traversing operation in order to leave the area in a sanitized dry condition.

More importantly, the use of such a suction head device, which invariably is manipulated by an elongated handle, is not suitable where extreme bacteriological precautions must be followed, inasmuch as it is extremely difficult to guide the device into hard-to-reach places such as corners and the like. Because of this, a subsequent individual localized cleaning and sterilizing of such places must be performed by hand methods such as the use of a string mop or a clean cloth. Thus, since no satisfactory suction head type of device has been found to date, most pharmaceutical laboratories and hospitals prefer use of the conventional mop and pail combination, both for applying and removing the detergent solution. However, even though a properly used string mop will reach most hard-to-get-at places, mopping operations are time-consuming, messy, and leave much to be desired. The transportation of the accompanying pail at frequent intervals, splashing or squirting the liquid during mop wringing operations so as to leave deposits on adjacent walls or previously sanitized floor areas, wetting of the hands, and other difficulties accompany the use of a string mop and pail combination. Also overlap operations are among the features that contribute to mopping difficulties. Despite such limitations, many pharmaceutical laboratories and hospitals continue to rely upon mop and pail practice which, if carefully performed, will usually, but not always, afford bacteria-free cleaning at the expense of the use of skilled labor.

The present invention is designed to overcome the above-noted limitations that are attendant upon present day anti-bacteriological cleaning processes and, toward this end the invention contemplates the provision of a novel vacuum cleaning apparatus of the suction head squeegee type wherein the suction head, although it rests squarely on the floor undergoing cleaning, has associated therewith a rear carriage extension which is caster-supported and to which the lower end of an elongated handle is attached by means of a universal joint connection. The arrangement is such that when the handle is manipulated in the usual manner of string mop operation, the suction head traverses the floor in much the same manner as do the trailing strings of a conventional mop. By such an arrangement, no extra skill other than that which is required for operation of the conventional mop need be acquired by the operator of the apparatus. The suction head may be guided by the operator to cover all surfaces to be cleaned, including corner areas and regions in the vicinity of fixed objects, manipulation of the handle remaining familiar to any operator who has heretofore used a conventional string mop.

The provision of a vacuum cleaning apparatus such as has briefly been outlined above constitutes the principal object of the present invention.

Structurally, the suction head of the present vacuum cleaning apparatus offers numerous advantages over similar suction head type devices which are designed for cleaning floors and, among these advantages is the fact that the suction head proper is a separately fashioned, self-contained device which is capable of being slid bodily as a unit into and out of operative position and cooperation with respect to the carriage extension which guides it without necessitating the use of fastening screws, bolts or other anchoring devices, a simple releasable detent means being employed so that the unit may be snapped into position on the carriage. Another advantageous feature of the present suction head resides in the provision of separate hose-like connections, one inside the other, by means of which a liquid detergent may be directed onto the floor surface undergoing treatment in the immediate vicinity of, but outside the suction chamber, and also by means of which the detergent which finds its way into the suction chamber may be conducted to a suitable waste receptacle. Yet another feature of the present dual-squeegee suction head is predicated upon the fact that the rear "squeegee" is disposed in the immediate vicinity of a detergent applying nozzle and is of a porous sponge or pad-like nature through which the detergent liquid is drawn from the floor for subsequent conduction to the waste receptacle. The incorporation of these structural features in the suction head to attain the stated advantages constitute additional objects of the invention.

Numerous other objects and advantages of the invention, not at this time enumerated, will become readily apparent as the nature of the invention is better understood.

In the accompanying two sheets of drawings forming a part of this specification, one illustrative embodiment of the invention has been shown.

Figure 1:
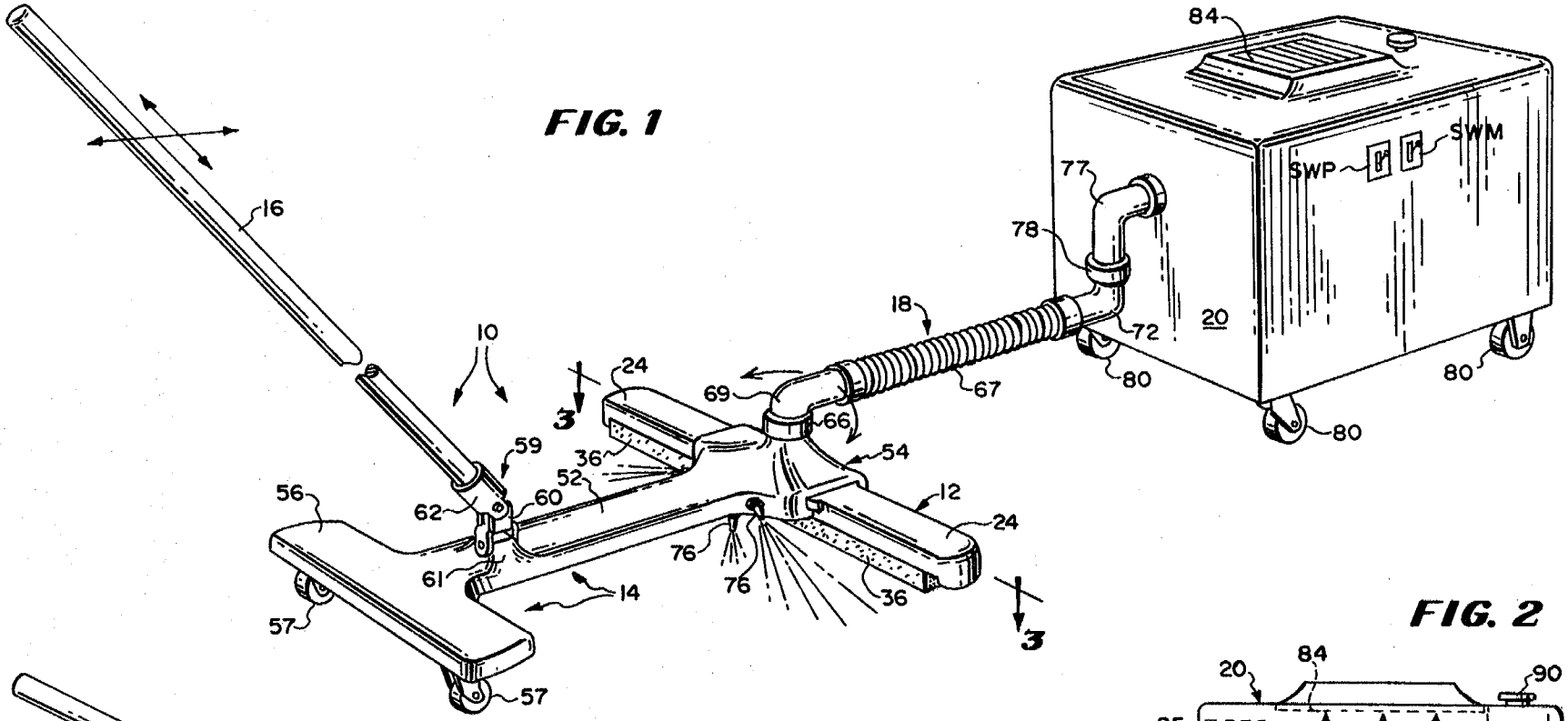
FIG. 1 is a perspective view of a vacuum cleaning apparatus embodying the principles of the present invention and showing the same operatively connected to a source of liquid detergent and to a source of vacuum pressure.
Figure 2:
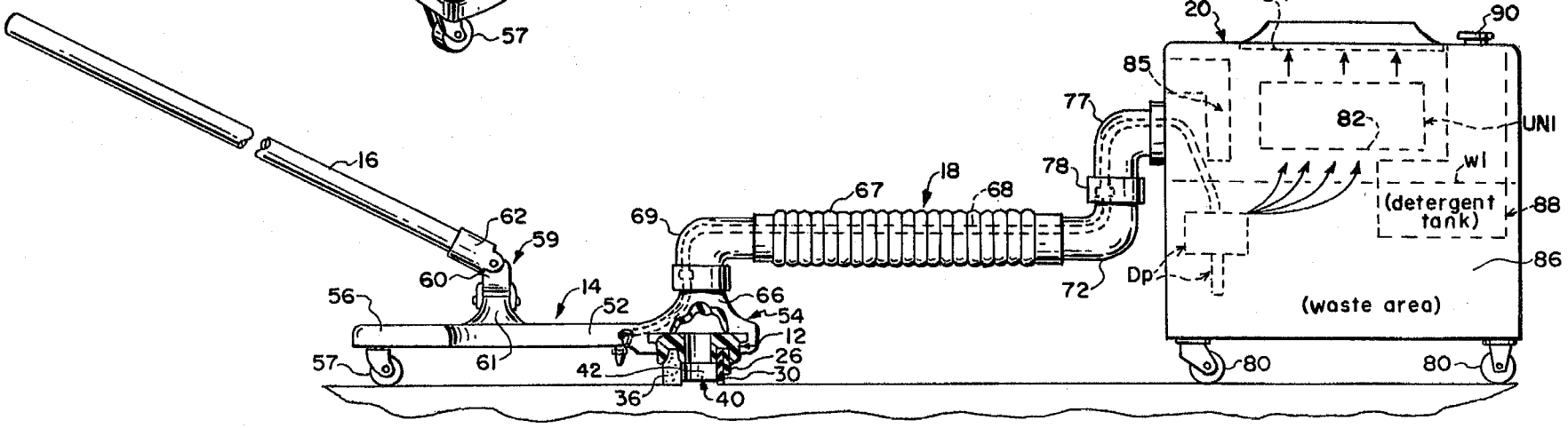
FIG. 2 is a side elevational view of the structure shown in FIG. 1.

Referring now to the drawings in detail, and in particular to FIGS. 1 and 2, the vacuum cleaning apparatus of the present invention includes a floor-supported guide cleaning unit which is designated in its entirety by the reference numeral 10 and it is comprised of four principal parts, namely a suction head 12, a caster supported carriage 14, an operating handle 16, and a compound flexible hose-like connection 18, by means of which sub-atmospheric pressure may be applied to the suction head 12, while at the same time a liquid or semi-liquid detergent may be applied to the floor undergoing cleaning.

The cleaning unit 10 is adapted to be used in connection with an auxiliary cart-like, caster-supported combined fluid supply and waste receptacle 20 which, per se, forms no part of the present invention and which may vary widely in its structural details, the only requisite being that it be caster-supported and that it affords a supply of the detergent liquid, together with means for pumping the same to the apparatus 10 for floor distribution as will be made clear presently, and also that it be provided with a storage space or tank to which the waste material may be returned from the suction head 12, together with a suitable vacuum or suction pump for effecting the return.

Considering now the suction head 12 of the floor-supported vacuum cleaning unit 10, and referring additionally to FIGS. 2, 3, 4 and 5, such head is in the form of an elongated body or top wall 24 which preferably, but not necessarily, is formed of a suitable plastic material and from which there depends in spaced apart relationship a flexible front squeegee member 26 which is formed of rubber or other suitable elastomeric material, the squeegee being set within a retaining groove 27 (FIG. 4) that is substantially coextensive with the body 24 and extends along the front longitudinal edge of the latter. A reinforcing strip 28 is provided along a major portion of the squeegee 26, thus leaving a flexible lower squeegee lip 30. A second groove 34 which extends along the rear longitudinal edge of the body 24 receives therein the upper end of a second squeegee-like floor-engaging porous pad 36 which is of an abrasive nature. The two squeegee-like members 26 and 36 define therebetween a suction chamber 40, the ends of which are substantially closed by rounded depending end walls 42. A central outlet slot 44 for the suction chamber 40 is provided in the body 24.

Figure 4:
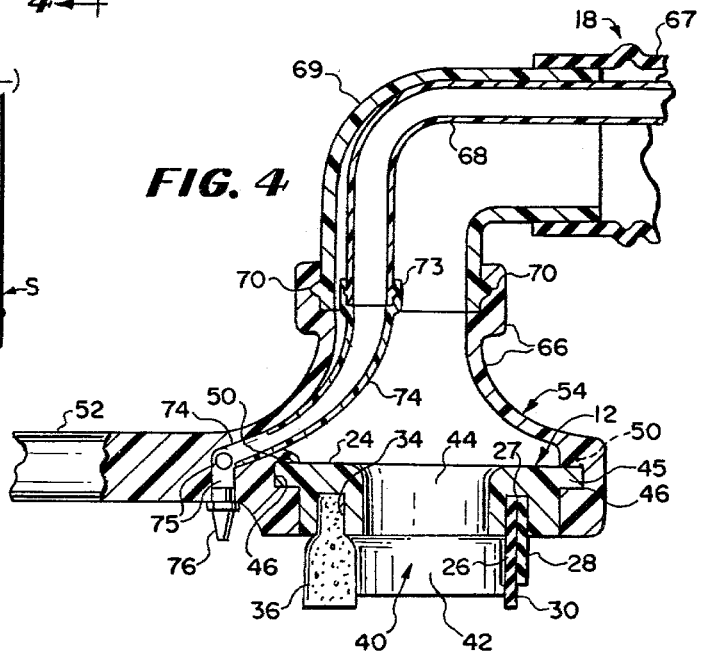
FIG. 4 is a sectional view taken on the line 4—4 of FIG. 3.
Figure 4:
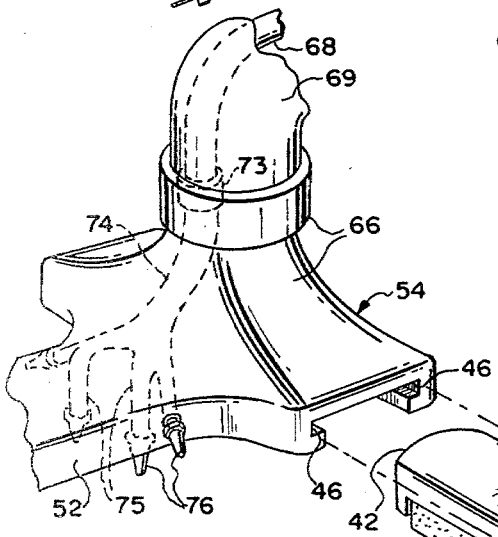
Figure 5:
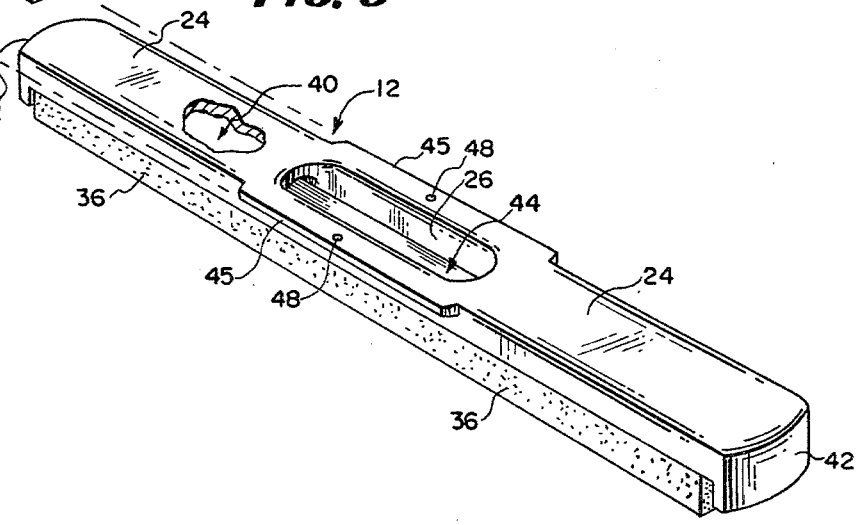
FIG. 5 is an exploded perspective view of the suction head and its associated sheath-like carrier which is provided on the forward end of the carriage extension.

As best shown in FIGS. 4 and 5, a pair of laterally projecting flanges 45 are formed on the front and rear sides of the body 24 and are slidably received in opposed grooves 46 which are associated with the carriage 14 and the nature of which will be set forth when a description of such carriage is made subsequently. Detent means including small deformable and yieldable detent protuberances 48 which are formed on the flanges 45 cooperate with detent recesses 50 associated with the grooves 46 in releasably retaining the suction head 12 in a centered position with respect to the carriage 14 as likewise will be described presently.

Referring again to FIGS. 1 and 2, the carriage 14 is in the form of a generally T-shaped structure which likewise is preferably formed of a plastic material and it includes an elongated central beam 52, the forward end of which is provided with an enlarged sheath portion 54 and the rear end of which is formed with a transverse T-head 56 mounted on a pair of casters 57. The lower end of the handle 16 is attached to the beam 52 adjacent the rear end thereof, i.e. in the vicinity of the transverse caster-supported T-head 56, by means of a universal joint assembly 59 having a lower suction 60 which is pivoted on a boss 61 so that it may swing from side to side, and an upper section 62 which is pivoted to the lower section 60 so that it may swing from front to rear. The lower end of the handle 16 is secured in the upper section 62. From the above description it will be apparent that the universal joint 59 is a partial one which will allow both fore and aft swinging movement of the handle, as well as side-to-side swinging movement, but it will not permit twisting or rotational movement of the handle relative to the beam 52. Any such twisting movement will be resisted by the pivotal connections which are established between the lower section 60 and the boss 61, and between the upper and lower sections.

Considering now the shape or outline characteristics of the floor cleaning unit 10, as best seen in FIG. 1 the carriage 14 which includes the rear transverse T-head 56, and the longitudinally extending beam 52 has aptly been referred to as being of T-shape design. However, when the elongated transversely slidable suction head 12 is fully and operatively applied to the sheath portion 54 at the front of the beam, the completely assembled unit assumes an H-shaped configuration.

Figure 3:
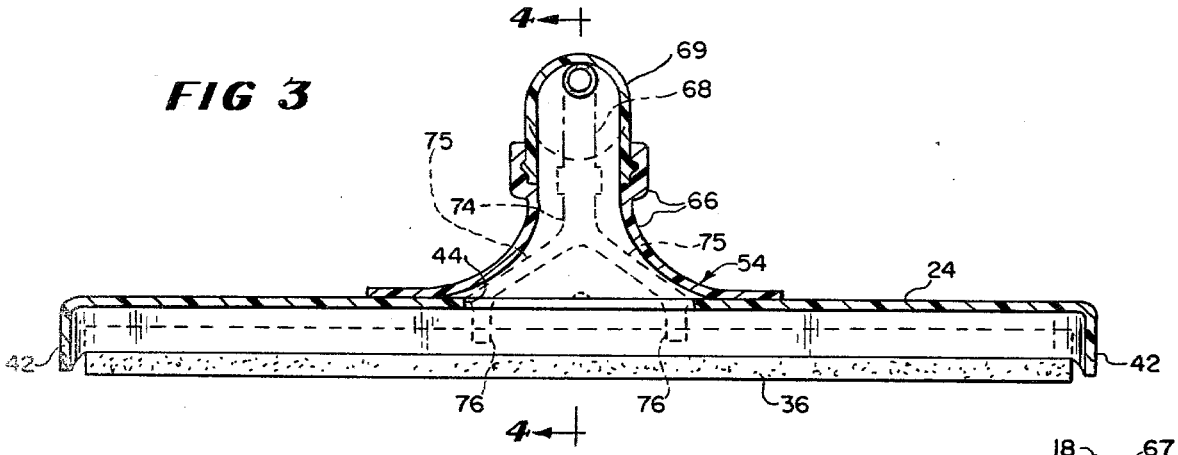
FIG. 3 is an enlarged sectional view taken through the suction head of the apparatus, the view being taken on the vertical plane indicated by the line 3—3 of FIG. 1.

The sheath portion 54 is of hollow construction and it is provided with an upstanding tapered nipple 66 (see also FIGS. 3 and 4). The nipple 66 is integrally formed on the extreme forward end of the beam 52 and, when the suction head 12 is in place on the carriage 14, the nipple registers with the central outlet slot or opening 44 in the body 24 of the suction head 12. The lower wall region of the sheath portion 54 has provided therein the afore-mentioned opposed grooves 46 which receive the flanges 45 of the suction head 12.

The aforementioned detent recesses 50 are provided in the upper horizontal walls of the grooves 46 as shown in FIG. 4, and the nature of the yieldable detent protuberances 48 is such that when the suction head is slid to its home position within the sheath portion 54, the detent protuberances 48 flatten into the material of such walls and snap into the detent recesses 50 at such time as the suction head 12 becomes centered relative to the beam 52.

Referring now to FIGS. 1 to 4 inclusive, the flexible compound hose connection 18 is a dual-purpose connection and it is provided both for the purpose of applying a detergent fluid to the floor surface undergoing cleaning, and for the purpose of vacuumizing the interior suction chamber which is established by the two squeegee-like members 26 and 36. Accordingly, the flexible connection 18 consists of an outer large diameter hose or tubing 67 through which there passes a small diameter hose or tubing 68. The small size hose 68 is provided for the purpose of supplying the detergent liquid to the floor undergoing cleaning, while the large size hose is employed for the purpose of vacuumizing the suction chamber 40 to enable the applied detergent liquid on the wetted floor surface to be removed in the manner of usual dual squeegee devices of the character under consideration.

Accordingly, insofar as vacuumizing the suction chamber 40 is concerned, and with reference to FIGS. 2 and 4, the proximate end of the hose 67 is provided with an elbow fitting 69 which encompasses the upstanding nipple 66 of the sheath portion 54 of the beam 52 with a rotatable snap fit as indicated at 70 and thus communicates with the suction chamber 40 of the suction head 12. The distal end of the hose 67 is provided with an elbow fitting 72 similar to the elbow fitting 69, the fitting 72 communicating with a source of subatmospheric pressure which is developed in the cart-like receptacle 20, all in a manner that will be made clear presently.

Insofar as the application of a detergent liquid to the floor surface is concerned, the proximate end of the small size hose 68 is releasably secured to a hose extension 73 (FIG. 4) by means of a suitable coupling, while the lower end of the extension is press fitted in the upper end of a manifold passage 74 which is formed in the forward region of the beam 52 immediately rearwardly of the sheath portion. The passage 64 communicates with a plurality of diverging branch passages 75 and the outer ends of such branch passages have fitted therein respective nozzles 76 by means of which the detergent liquid is directed onto the floor undergoing treatment.

It is to be noted at this point that the elbow fitting 69 is freely rotatable about the vertical axis of the nipple 66 due to the nature of the snap fit connection 70, while similarly the elbow fitting 72 is rotatable about the vertical axis of a companion fitting 77 by means of which the fitting is caused to communicate with the interior of the receptacle 20. The two elbow fittings 72 and 77 communicate through a circular ring member which establishes a swinging connection for the lower fitting 72. By such an arrangement, the receptacle 20 follows the floor-supported cleaning unit 14 as it moves from place to place.

As previously stated, the trailing receptacle 20 may vary widely in its construction and any novelty which may be associated therewith will not be claimed in the present application. However, in the interests of clarifying the operation of the floor cleaning unit 10, a brief description of the components associated therewith and of their functions will be made herein.

Referring now specifically to FIGS. 1 and 2, the cart-like receptacle, being a trailing vehicle, is provided with a series of four casters 80. As previously stated, this vehicle or receptacle forms no part of the present invention except insofar as it is a necessary adjunct to efficient use of the floor cleaning unit 10. There are in existence other cart-like vehicles, as well as portable equipment which may be moved from place to place, and having internal equipment similar to that shown in FIG. 2 in schematic fashion, and which is designed for the same purpose. Certain of these cart-like vehicles may be substituted bodily with but little modification for the vehicle 20 illustrated herein. A trailing vehicle capable of performing the necessary functions for incorporation in the present apparatus as an adjunct to the floor cleaning unit 10 is shown and described in U.S. Pat. No. 1,661,480, granted on Mar. 6, 1928 and entitled "Surface Cleaning Machine." Although it is not of a tractionally trailing nature, it is portable for the purpose of repeatedly carrying it to the vicinity of the suction head. Another suitable tractionally supported trailing vehicle of cart-like design is manufactured under the trade name "Duovac" by Burnside Equipment Ltd. of Toronto, Canada and is advertised as Model 212 HS. Other similar units are believed to be in existence and therefore only a schematic disclosure of the function performed by the present cart-like vehicles, will be made herein.

As shown in dotted lines in FIG. 2, a conventional vacuum motor VM is disposed within the receptacle 20 and, when energized it draws moisture and air from the flexible hose 62 through the elbow fittings 72 and 77 and pulls it through a preliminary filter 82 thereafter discharging it through a final outlet filter 84. Such air, as it enters the reservoir 20 is directed against a baffle or splash plate 85 where the accompanying liquid falls by gravity to a waste-receiving tank area 86 which is defined by the bottom and vertical walls of the receptacle 20, this area also being labeled as such. A detergent tank 88 (also labeled as such) having a filling cap 90 is removably disposed within the receptacle and contains a supply of a suitable anticeptic solution or detergent.

Submerged with the waste area 86, or at least below the highest expected liquid level indicated by the line wl, is a detergent pump DP which operates somewhat in the manner of a conventional sump pump (FIGS. 1 and 6) with the exception that it is not automatically operated according to liquid pressure. Instead, it is a normally deenergized pump which is adapted to be energized under the control of a switch SWP (FIGS. 1 and 6) which is activated at the commencement of floor wetting operations. The motor VM is operated by a switch SWM adjacent the switch SWP which is activated when vacuum cleaning operations are commenced.

Figure 6:
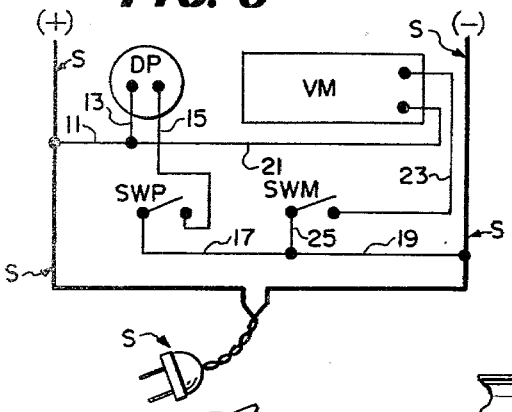
FIG. 6 is an electrical circuit diagram showing one form of circuit control which may be employed in connection with the invention.

Referring now to the electrical diagram of FIG. 6, the two switches SWP and SWM are independently operable. Upon closure of the normally open switch SWP, a circuit will extend from the current source (which may be a conventional wall outlet plug) S, through connector leads 11, 13, the submerged detergent pump DP, lead 15, the switch SWP, and leads 17, 19, back to the source, thus energizing the pump DP for floor-wetting purposes as previously described. Upon closure of the switch SWM, a circuit will extend from the source S, through leads 11, 21, the vacuum motor VM, lead 23, the switch SWM, and leads 25, 19 back to the source, thus energizing the vacuum motor VM.

In the operation of the cleaning apparatus, and with reference to FIG. 1, if the apparatus is to be employed solely for removing waste liquid material which was previously applied to the floor for floor-wetting purposes, the switch SWP on the cart-like trailing receptacle will be left in its normally open condition so that the detergent pump DP will remain deenergized. The switch SWM will be closed so as to energize the vacuum motor VM, thus applying suction to the chamber 40 between the forward squeegee member 26 (FIG. 4) and the porous abrasive pad 36 of the suction head 12. Thereafter, with the vacuum motor VM in continuous operation, the unit 14 is manipulated under the control of the handle 16 to vacuum mop the floor surface.

It is deemed pertinent to note at this point that the manipulating operations which are performed on the suction head under the control of the handle 16 closely parallel those which are performed when using a conventional string mop. The most efficient mopping operations in such a case are effected when the mop head is drawn rearwardly or backwards, i.e. toward the operator. Such backward motion of the mop head allows the mop strings to trail the mop head, while at the same time absorbing liquid or moisture. Forward motion of a string mop head is far less efficient from the point of view of moisture pick up or absorption since such forward motion merely bunches the mop strings together in a wad and pushes a limited amount of moisture forwardly on the floor. An experienced string mop user will ordinarily accompany his backward stroke of the mop head with a side-to-side swinging movement of the handle, thus covering a wide floor area as the mop head moves rearwardly with the strings performing their absorbent action over a wide swath. Similar phenomena accompany the use of the present unit 14 when the operator performs the same rearward and side-to-side swinging movement of the handle 16 inasmuch as the lower end of the latter is attached by a universal joint as shown at 61 to a region close to the rear end of the beam 14. The use of the partial universal joint 59 between the lower end of the handle and the rear end region of the beam 52 allows the suction head 12 (which is capable of universal sliding movement in all directions) to be swung bodily as a unit endwise, which would not be the case if the joint 59 were a full swivel joint such as would be established if a ball and socket joint were used. The joint 61 facilitates guiding the suction head 12 so that it may be projected endwise into hard-to-get-at places such as corners or beneath and around fixed objects.

It is to be noted at this point that the suction head 12 receives substantially all of its support from the floor undergoing cleaning, the effect of the casters 37 on the T-head 56 being so remote from the suction head that they have practically no effect on the mass or weight of the latter.

In an instance where it is desired to confine the application of the detergent liquid to small areas of the floor in the vicinity of the suction head 12, as distinguished from total overall wetting of the floor, the operator, in addition to closing the switch SWM, also closes the switch SWP, thus energizing the submerged detergent pump DP and sending the liquid detergent from the detergent tank 88 through the small size hose 64 to the various nozzles 76 in the manner previously described. In such an instance, the liquid is applied to the floor immediately behind or rearwardly of the suction head 12 and exteriorly of the suction chamber 40. During mopping operations, as the suction head 12 is moved rearwardly toward the operator, the sponge-like porous absorbent pad 36 builds up small areas or pools of the liquid on the floor and the relatively high vacuum pressure within the suction chamber 40 rapidly draws the liquid in these pools through the pad for expulsion from the suction chamber, through the large diameter hose 66 and into the waste area 86 of the cart-like receptacle 20. Forward motion of the suction head 12 is substantially without function since the floor area ahead of the unit has previously been rendered dry.

The invention is not to be limited to the exact structure shown in the accompanying drawings or described in this specification as various changes in the details of construction may be resorted to without departing from the spirit of the invention. Therefore, only insofar as the invention has particularly been pointed out in the accompanying claims is the same to be limited.

Having thus described my invention, what I claim and desire to secure by letters patent is:

1. In a floor cleaning and sanitizing apparatus of the character described, in combination a cleaning unit comprising an elongated transversely extending inverted cup-shaped suction head designed for direct support on, and universal multidirectional sliding movement over a floor surface to be cleaned and including a transversely elongated top wall, depending end walls, and front and rear spaced apart depending flexible floor-engaging members establishing an internal downwardly opening suction chamber, said suction head having means whereby said chamber may be connected to a source of sub-atmospheric pressure, a guide carriage for said suction head in the form of a generally T-shaped member including a longitudinally extending beam connected at its forward end to a medial region of the suction head and extending rearwardly therefrom and having a transversely extending T-head at its rear end, thus rendering the cleaning unit generally of H-shape configuration, caster means tractionally supporting the T-head from the floor, an elongated operating handle for said unit, and a universal joint connecting the lower end of said handle to said beam in close proximity to said T-head, whereby components of rearward, as well as side-to-side, movements of the handle will effect commensurate trailing sliding movements of the suction head on the floor.

2. In a floor cleaning apparatus, the combination set forth in claim 1, wherein said tractional supporting means for the T-head comprises a pair of casters, one at each end region of the T-head.

3. In a floor cleaning apparatus, the combination set forth in claim 1, wherein the rear floor-engaging member is of a flexible porous nature, jet-producing means are carried on said beam for directing a stream of liquid detergent onto the floor in the vicinity of said rear floor-engaging member and rearwardly of the latter, and means are provided whereby said jet-producing means may be connected to a source of the liquid detergent.

4. In a floor cleaning apparatus, the combination set forth in claim 3, wherein said rear flexible floor-engaging member is in the form of a porous abrasive pad.

5. In a floor cleaning apparatus, the combination set forth in claim 4, wherein said jet-producing means is in the form of at least one liquid-discharging nozzle effectively disposed immediately rearwardly of said abrasive floor-engaging member.

6. In a floor cleaning apparatus, the combination set forth in claim 5, wherein the large and small diameter hoses are effectively connected at their distal ends to a tractionally supported cart-like trailing vehicle embodying said source of sub-atmospheric pressure and said source of liquid detergent.

7. In a floor cleaning apparatus, the combination set forth in claim 3, wherein the connecting means for said suction head comprises a large diameter flexible hose, and the connecting means for said jet-producing means is in the form of a small diameter hose disposed within the large diameter hose and substantially coextensive therewith.

8. In a floor cleaning and sanitizing apparatus, a cleaning unit comprising an elongated transversely extending inverted cup-shaped suction head designed for universal multi-directional sliding movement over a floor surface to be cleaned and including a transversely elongated top wall, depending end walls, and front and rear spaced apart depending flexible floor-engaging members establishing an internal downwardly opening suction chamber, said suction head having means whereby said chamber may be connected to a source of sub-atmospheric pressure, a guide carriage for said suction head in the form of an elongated longitudinally extending beam connected at its forward end to a medial region of the suction head and extending rearwardly therefrom, caster means tractionally supporting the rear end of the beam from the floor, an elongated operating handle for said unit, and a universal joint connecting the lower end of the handle to said beam adjacent the rear end of the latter and remote from the suction head, whereby components of rearward, as well as side-to-side, movements of the handle will effect commensurate trailing movements of the suction head on the floor.

9. In a floor cleaning and sanitizing apparatus, the combination set forth in claim 8, wherein the medial region of said suction head is provided with means whereby it may be removably connected to the forward end of the beam.

10. In a floor cleaning and sanitizing apparatus, the combination set forth in claim 8, wherein the forward end of said beam is formed with an enlarged sheath portion presenting opposed grooves, and said suction head is provided with tongues which are slidably and removably receivable within said grooves.

11. In a floor cleaning and sanitizing apparatus, the combination set forth in claim 10, wherein said tongues are in the form of lateral flanges which are coplanar with said top wall of the suction head.

12. In a floor cleaning and sanitizing apparatus, the combination set forth in claim 10 including, additionally, detent means for removably maintaining said suction head in a centered position with respect to the longitudinal axis of said beam.

* * * * *